US005842100A

United States Patent [19]

Yanashima et al.

[11] Patent Number: 5,842,100

[45] Date of Patent: Nov. 24, 1998

[54] FIXING UNIT

[75] Inventors: Tsukasa Yanashima; Masatoshi Takano; Tomoyuki Nishikawa; Tsutomu Sato; Kasumi Yamamoto; Yutaka Ishikawa, all of Tokyo, Japan

[73] Assignee: Asahi Kogaku Kogyo Kabushiki Kaisha, Tokyo, Japan

[21] Appl. No.: 906,263

[22] Filed: Aug. 5, 1997

[30] Foreign Application Priority Data

Aug. 7, 1996 [JP] Japan ..... 8-224395

[51] Int. Cl.[6] ..... G03G 15/20

[52] U.S. Cl. ..... 399/328; 399/332; 399/330

[58] Field of Search ..... 355/405; 101/494; 399/332, 331, 330, 328

[56] References Cited

U.S. PATENT DOCUMENTS 5,144,360 9/1992 Ishida ..... 355/27
5,253,013 10/1993 Takano et al. ..... 399/130
5,564,845 10/1996 Yamaguchi et al. ..... 400/582
5,572,307 11/1996 Tomatsu et al. ..... 399/122
5,666,627 9/1997 Yamaguchi ..... 399/330

*Primary Examiner*—Edgar S. Burr
*Assistant Examiner*—Daniel J. Colilla
*Attorney, Agent, or Firm*—Greenblum & Bernstein, P.L.C.

[57] ABSTRACT

A fixing unit includes a heat roller accommodating a heater and a press roller movable toward and away from the heat roller. Both shaft members of the heat roller are supported by two receiving members, with a clearance provided between each shaft member and respective receiving member. A driven gear is provided to one of the shaft member, which engages a rotating mechanism for rotating the heat roller. The fixing unit further includes a biasing member which biases the other shaft of the heat roller away from the press roller within the clearance, in such a manner that the heat roller and the press roller become parallel when the above-described one shaft member is urged away from the press roller due to the meshing engagement of the driven gear and the rotating mechanism.

14 Claims, 9 Drawing Sheets

FIXING UNIT

BACKGROUND OF THE INVENTION

The invention relates to a fixing unit used in a printer such as an electrophotographic printer, for fixing images on a recording sheet.

In a printer such as an electrophotographic printer, a fixing unit is provided for fixing the toner image on the recording sheet. The fixing unit includes a heat roller accommodating a heater therein, and a press roller having a surface made of an elastic member. A recording sheet is pressed and heated between the heat roller and the press roller, so that the toner image is fixed on the recording sheet.

Further, the press roller is moved toward and away from the heat roller. That is, the press roller is moved between (1) an operating position where the press roller presses the recording sheet to the heat roller and (2) a retracted position where the press roller is apart from the heat roller.

The heat roller is rotated in synchronization with the feeding of the recording sheet (generally performed by a tractor unit). If the feeding of the recording sheet is stopped while the recording sheet is in contact with the heat roller for a long time, the recording sheet may become excessively dry. In order to avoid this problem, the recording sheet is nipped by the heat roller and the press roller only when the recording sheet is being fed. That is, the press roller is moved to the operating position after the feeding of the recording sheet is started.

Generally, the press roller is not directly linked to a driving source, but is rotatable in accordance with the rotation of the heat roller (when the press roller is pressed against the heat roller with a recording sheet P interposed therebetween). That is, the press roller is not rotated when located at the retracted position.

Thus, there is a significant speed difference between the recording sheet and the press roller at a moment when the press roller moves to the operating position and contacts the recording sheet. If one lateral end of the recording sheet is brought into contact with the press roller earlier than the other lateral end of the press roller, the early-contact end of the recording sheet may decelerate for a moment, while the other lateral end may not decelerate. This causes a so-called "skew", wherein the recording sheet is inclined with respect to the feeding direction of the recording sheet.

SUMMARY OF THE INVENTION

It is therefore an object of the present invention to provide a fixing unit wherein a skew of the recording sheet is prevented.

According to an aspect of the invention, there is provided a fixing unit including a heat roller accommodating a heater and having a pair of shaft members at both axial ends thereof, two receiving members which receive both shafts of the heat roller (with a clearance provided between each shaft and respective receiving member), a press roller movable toward and away from the heat roller, an opening/closing mechanism which moves the press roller to open and close a gap between the press roller and the heat roller, a rotating mechanism which rotates the heat roller, the rotating mechanism provided to the same side as the press roller with respect to the heat roller, a driven gear provided to at one shaft member of the heat roller, and the driven gear being driven by the rotating mechanism. The fixing unit further includes a biasing member which biases the other shaft member of the heat roller away from the press roller within the clearance, so that the heat roller and the press roller become parallel when the above-described one shaft member is urged away from the press roller due to the meshing engagement of the driven gear and the rotating mechanism.

In a particular arrangement, bearings are provided between the shaft members and the receiving members, and the biasing member presses one of the bearings. In such case, it is preferred that a surface of the heat roller, the biasing member and the bearings are made of electrically conductive materials. With this, the surface of the heat roller can be electrically grounded by connecting the biasing member and an earth terminal.

Alternatively, it is possible to locate the biasing member so that the biasing member directly presses one of shaft members of the heat roller. In such case, it is preferred that a surface of the heat roller and the biasing member are made of electrically conductive materials, so that the surface of the heat roller can be electrically grounded by connecting the biasing member and an earth terminal.

According to another aspect of the invention, there is provided a fixing unit which includes a heat roller accommodating a heater and having a pair of shaft members at both axial ends thereof, two receiving members which receive both shaft members of the heat roller (with a clearance provided between each shaft member and respective receiving member), a press roller movable toward and away from the heat roller, an opening/closing mechanism which moves the press roller to open and close a gap between the press roller and the heat roller, a rotating mechanism which rotates the heat roller, the rotating mechanism provided to the same side as the press roller with respect to the heat roller, and a driven gear provided to at one shaft member of the heat roller, the driven gear being driven by the rotating mechanism. The receiving members support the shaft members so that the above-described one shaft member of the heat roller is closer to the press roller than the other shaft member, so that the heat roller and the press roller become parallel when the above-described one shaft member is urged away from the press roller due to the meshing engagement of the driven gear and the rotating mechanism.

Particularly, a clearance between the above-described one shaft and the receiving member is set larger than a clearance between the other shaft and the receiving member.

DESCRIPTION OF THE PREFERRED EMBODIMENTS

A first embodiment of the present invention is described with reference to accompanied drawings.

Figure 1:
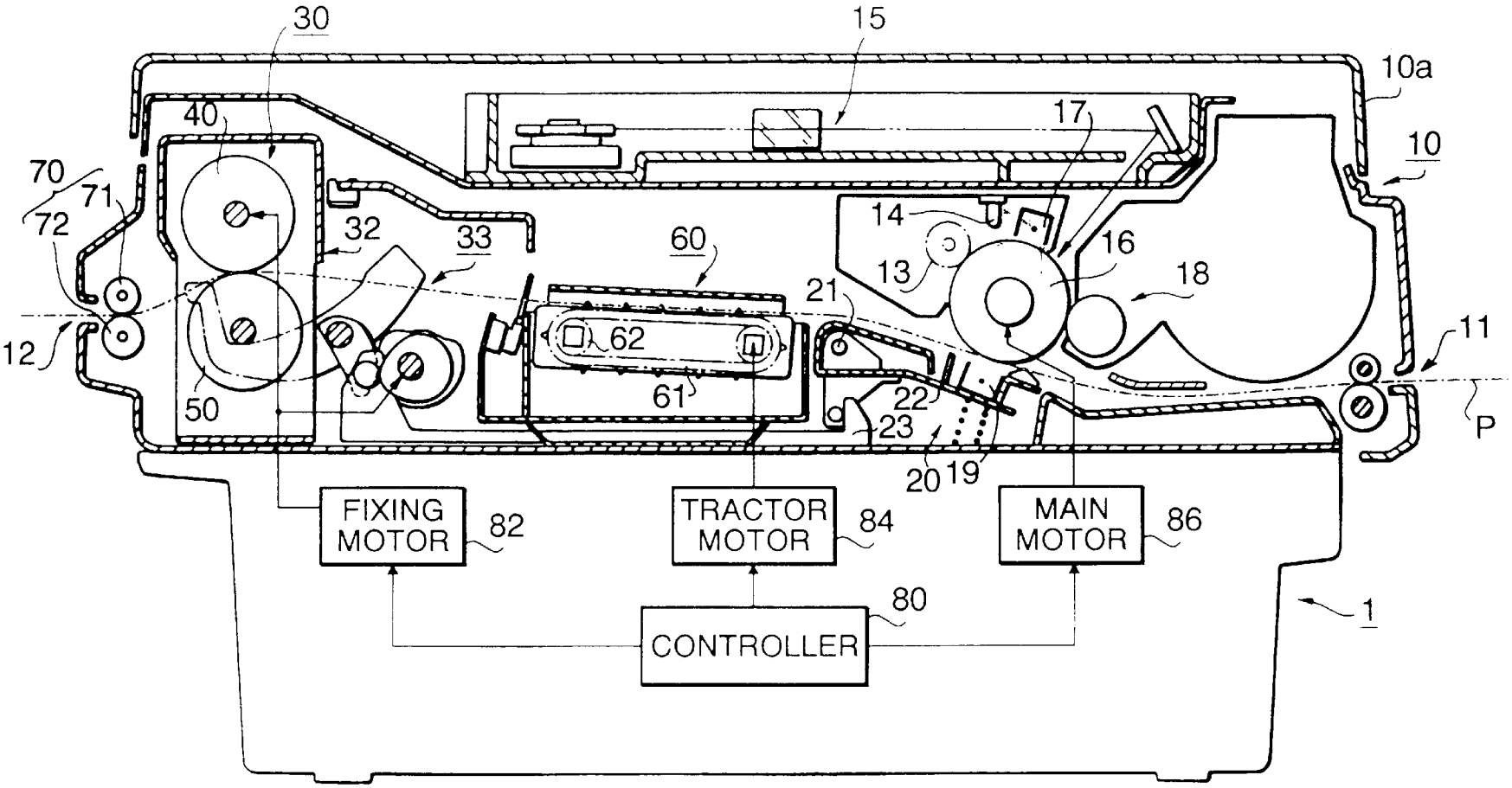
FIG. 1 is a sectional side view showing an arrangement of a printer.

FIG. 1 shows a continuous form printer 1 arranged to print images on a continuous form sheet (hereinafter recording sheet P) using an electrophotographic technology. The printer 1 includes a laser scanning unit 15 for emitting a laser beam, a photoconductive drum 16 on which a latent image is formed by the laser beam emitted from the laser scanning unit 15, a developing unit 18 for applying toner to the latent image formed on the drum 16, a transfer unit 20 for transferring a toner image from the drum 16 onto recording sheet P, and a fixing unit 30 for fixing the toner image on the recording sheet P, all of which are accommodated in a housing 10.

The printer 1 further includes a cleaning unit 13 for removing residual toner on the drum 16, a discharge unit 14 for discharging the surface of the photoconductive drum 16, and a charging unit 17 for uniformly charging the surface of the photoconductive drum 16.

The recording sheet P enters into the housing 10 from a sheet inlet 11 provided at one side. In the housing 10, the recording sheet P passes through the above-described transfer unit 20 and fixing unit 30 along a predetermined feeding path. Then, the recording sheet P is discharged from the housing 10 from a sheet outlet 12 provided at the opposite side to the inlet 11. Feeding of the recording sheet P in the housing 10 is performed by a tractor unit 60 provided between the transfer unit 20 and the fixing unit 30.

The tractor unit 60 comprises a tractor belt 61 entrained by a pair of pulleys 62. The tractor belt 61 has projections aligned in a row with predetermined pitches. These projections are engageable with feeding holes opened at lateral ends of the recording sheet P, with predetermined intervals equivalent to the pitches of the projections. The pulleys 62 are driven by a tractor motor 84. A discharge roller unit 70, for discharging the recording sheet P, is provided between the fixing unit 30 and the sheet outlet 12.

A printing process is performed by the following process. A laser beam is emitted from the laser scanning unit 15. The surface of the photoconductive drum 16 is exposed by this laser beam. The surface of the photoconductive drum 16 is uniformly charged by a charging unit 17 and is exposed by the above-described laser beam so as to form a latent image. The developing unit 18 applies toner to the latent image thus formed on the drum 16. A toner image is thus formed on the photosensitive surface of the drum 16 and is transferred onto the recording sheet P by a corona charger 19 provided in the transfer unit 20. The toner image transferred onto the recording sheet P is fixed on the recording sheet P by the fixing unit 30 under a given pressure and heat. Residual toner remaining on the photoconductive surface of the drum 16 is removed by the cleaning unit 13. Further, the surface of the photoconductive drum 16 is discharged by the discharge unit 14 for the next printing process. A controller 80 controls the tractor motor 84 (actuating the tractor unit 60); a later-described fixing motor 82 (actuating the fixing unit 30); and a main motor 86 (rotating the drum 16). The housing 10 has an upper housing 10*a* swingably supported by a support shaft (not shown) The laser scanning unit 15 is accommodated in this upper housing 10*a*. By opening the upper housing 10*a*, a user can access the fixing unit 30 or the tractor unit 60 from the top of the printer 1.

The fixing unit 30 includes a heat roller 40, accommodating a heat source therein, and a press roller 50 having a surface made of an elastic member. The heat roller 40 and the press roller 50 are accommodated in a detachable unit 32 which can be removed from the printer 1 by opening the upper housing 10*a*.

Furthermore, the fixing unit 30 includes an opening/closing mechanism 33 which opens and closes the gap between the heat roller 40 and the press roller 50. Specifically, the opening/closing mechanism 33 moves the press roller 50 between (1) an operating position where the press roller 50 presses the recording sheet P against the heat roller 40 and (2) a retracted position where the press roller 50 is apart from the heat roller 40. The opening/closing mechanism 33 is controlled to close the gap between the rollers (to nip the recording sheet P) when the recording sheet is being fed, and to open the gap (to release the recording sheet P) when the recording sheet is stopped.

The transfer unit 20 and the discharge roller unit 70 are also controlled in synchronization with the opening/closing mechanism 33 of the fixing unit 30. In the transfer unit 20, the corona charger 19 is provided on a swingable holder 22 swingably supported about a swing shaft 21. The swingable holder 22 is swingable between an operating position where the corona charger 19 faces the drum 16, and a retracted position where the corona charger 19 is apart from the drum 16. The swingable holder 22 is swung by a slide arm 23 that is slidable in a right-and-left direction (in FIG. 1) in synchronism with the opening/closing mechanism 33. The discharge roller unit 70 includes upper and lower rollers 71 and 72 arranged at upper and lower sides, respectively, of the feeding path of the recording sheet P. The upper roller 71 is linked with the opening/closing mechanism 33 by a linking mechanism (not shown), and is movable between an operating position where the upper roller 71 presses the recording sheet P to the lower roller 72 and a retracted position where the upper roller 71 is apart from the lower roller 72.

After the printing process is terminated, the printer 1 discharges the leading side of the recording sheet P out of the housing 10 by a length corresponding to an printed page, enabling users to cut the printed page 1 or to check the printed image. When the next printing process is started, the recording sheet P is retracted back into the housing 10. Then, the opening/closing mechanism 33 moves the press roller 50, corona charger 19 and the upper roller 71 to their retracted positions respectively to open the gap therebetween.

Figure 2:
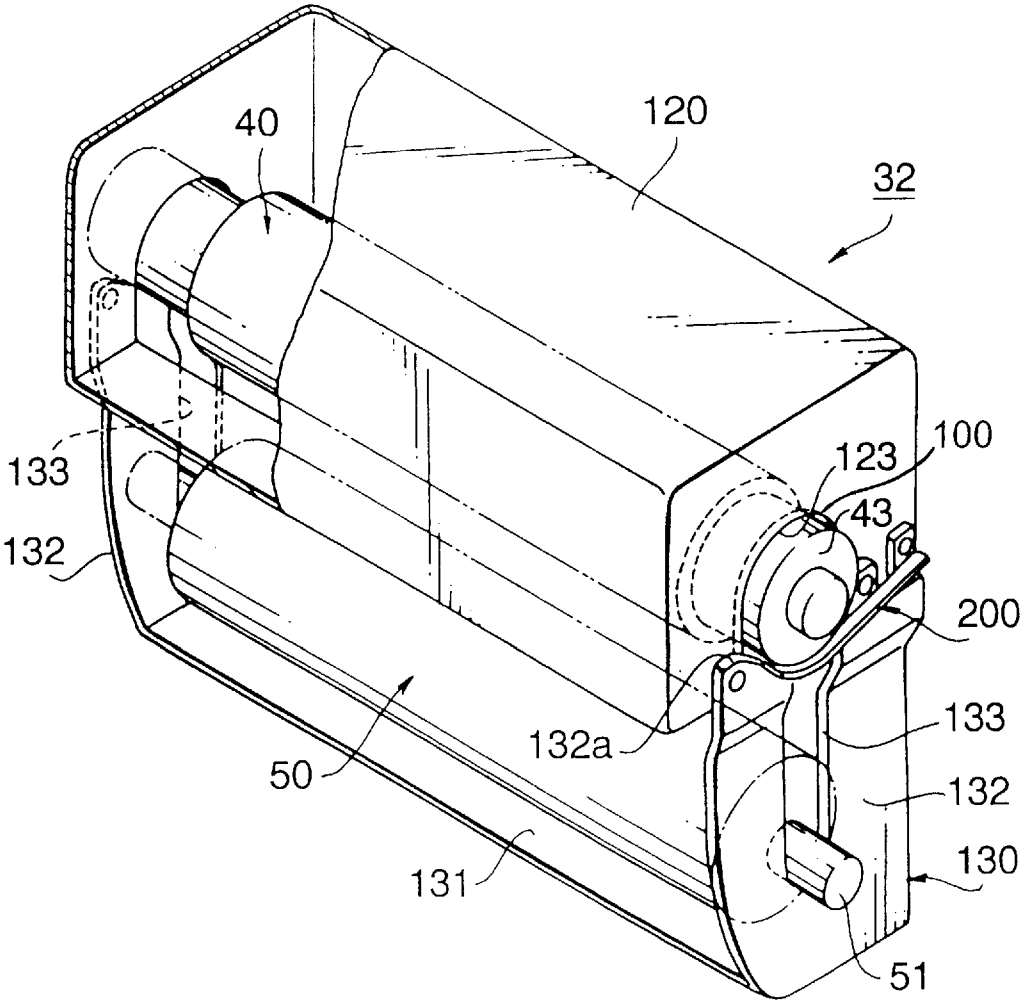
FIG. 2 is a perspective view showing a detachable unit of a fixing unit according to a first embodiment.

FIG. 2 is a perspective view of the detachable unit 32 including the heat roller 40 and the press roller 50. As shown in FIG. 2, the heat roller 40 and the press roller 50 are supported parallel with each other in upper and lower frames 120 and 130, respectively. The upper frame 120 is an rectangular box with an open bottom. The lower frame 130 is an angled plate member, which has bottom plate 131 having substantially the same longitudinal length as the upper frame 120, and opposed side plates 132 vertically extending from the longitudinal ends of the bottom plate 131 toward the upper frame 120.

The lower frame 130 is provided with U-shaped grooves 133 extending downward from an upper end 132*a* of each side plate 132. Each groove 133 has a width slightly wider than a center shaft 51 (described below) of the press roller 50, so that the center shaft 51 can be inserted from the upper end 132*a* of the side plate 132 and guided downward along the groove 133 to the lowermost end of the groove 133. The upper frame 120 is provided with U-shaped grooves 123 extending upward from a lower end of each longitudinal side wall. Each groove 123 has a width slightly larger than an outer diameter of a bearing 43 (described below) of the heat roller 40. The curved portion of the upper end 132*a* fits the peripheral surface of the bearing 43. Accordingly, the bearing 43 is supported between the groove 123 of the upper frame 120 and the curved portion of the upper end 132*a* of the side plate 132.

Figure 3:
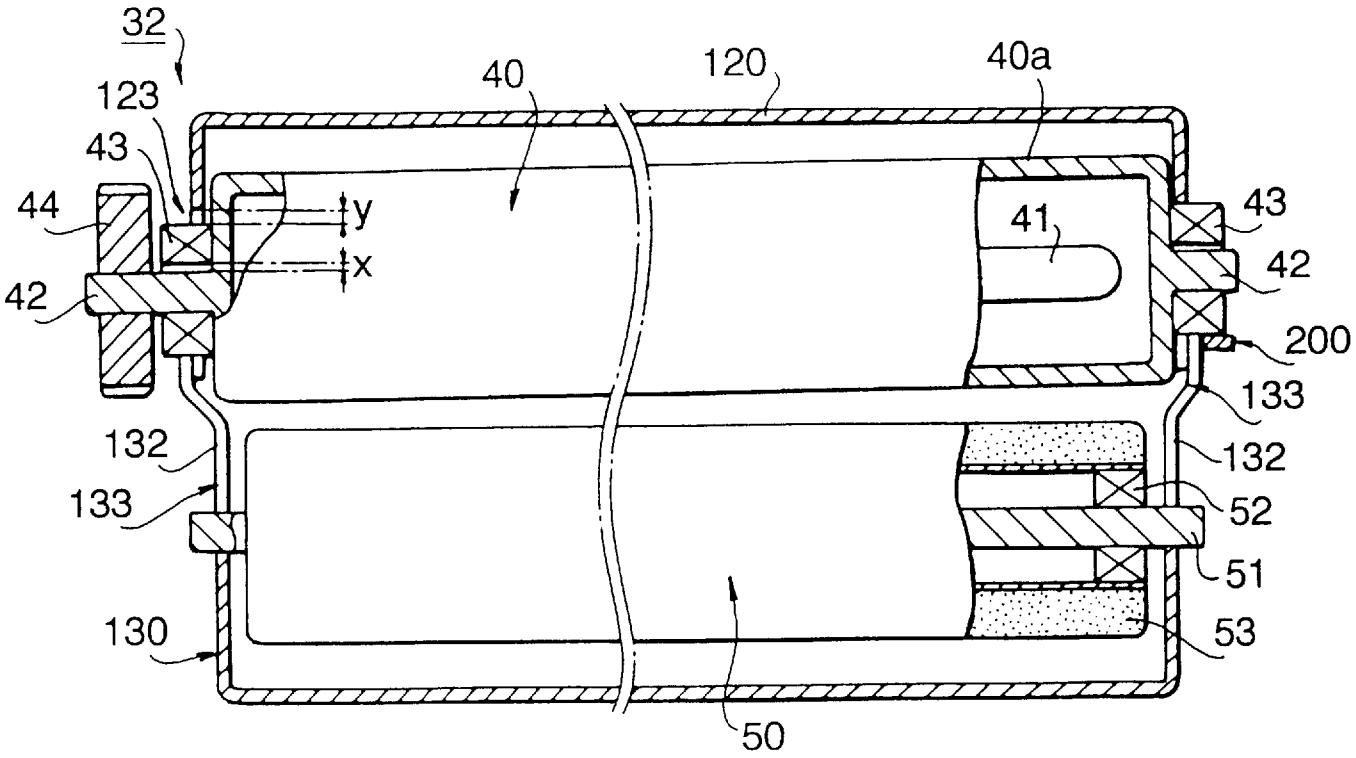
FIG. 3 is a sectional front view showing a fixing unit of the first embodiment.

FIG. 3 is a partial cutaway view of the detachable unit 32. The heat roller 40 has a hollow roller body 40*a* accommodating a heater 41 therein. Support shafts 42 are integrally formed at respective longitudinal ends of the roller body 40*a*. These shafts 42 are supported by the radial bearings. 43. A roller gear 44 is fixed to one of support shafts 42. A driving force for rotating the heat roller 40 is transmitted through the roller gear 44 to the roller body 40*a*.

The press roller 50 includes a roller body 53 having a surface is made of an elastic member such as a rubber. A center shaft 51 is provided to the center of the roller body 53, with bearings 52 inserted between the roller body 53 and the center shaft 51. The press roller 50 is not directly linked to a driving source but is rotatable in accordance with a rotation of the heat roller 40 when the press roller 50 is pressed against the heat roller 40 with a recording sheet P interposed therebetween.

When the heater 41 of the heat roller 40 is activated, the heat of the heater 41 is transmitted to the upper and lower frames 120 and 130 (through the roller body 40*a*, the support shaft 42 and the bearing 43). Since the support shaft 42 is heated earlier than the bearing 43, a clearance X is provided between the support shaft 42 and the bearing 43 permitting a difference in thermal expansion of the elements. Similarly, since the bearing 43 is heated earlier than the upper frame 120, a clearance Y is provided between the bearing 43 and the upper frame 120.

A plate spring 200 is provided at one side surface of the upper frame 120 for biasing one end of the heat roller 40. The plate spring 200 urges the bearing 43 provided to the support shaft 42 of the opposite side to the roller gear 44. As shown in FIG. 2, the plate spring 200 has a belt-like shape with its front end fixed to the upper frame 120. Since one end of the heat roller 40 is lifted up by the plate spring 200, the heat roller 40 is slightly inclined with respect to the press roller 50 (detailed below).

Figure 4:
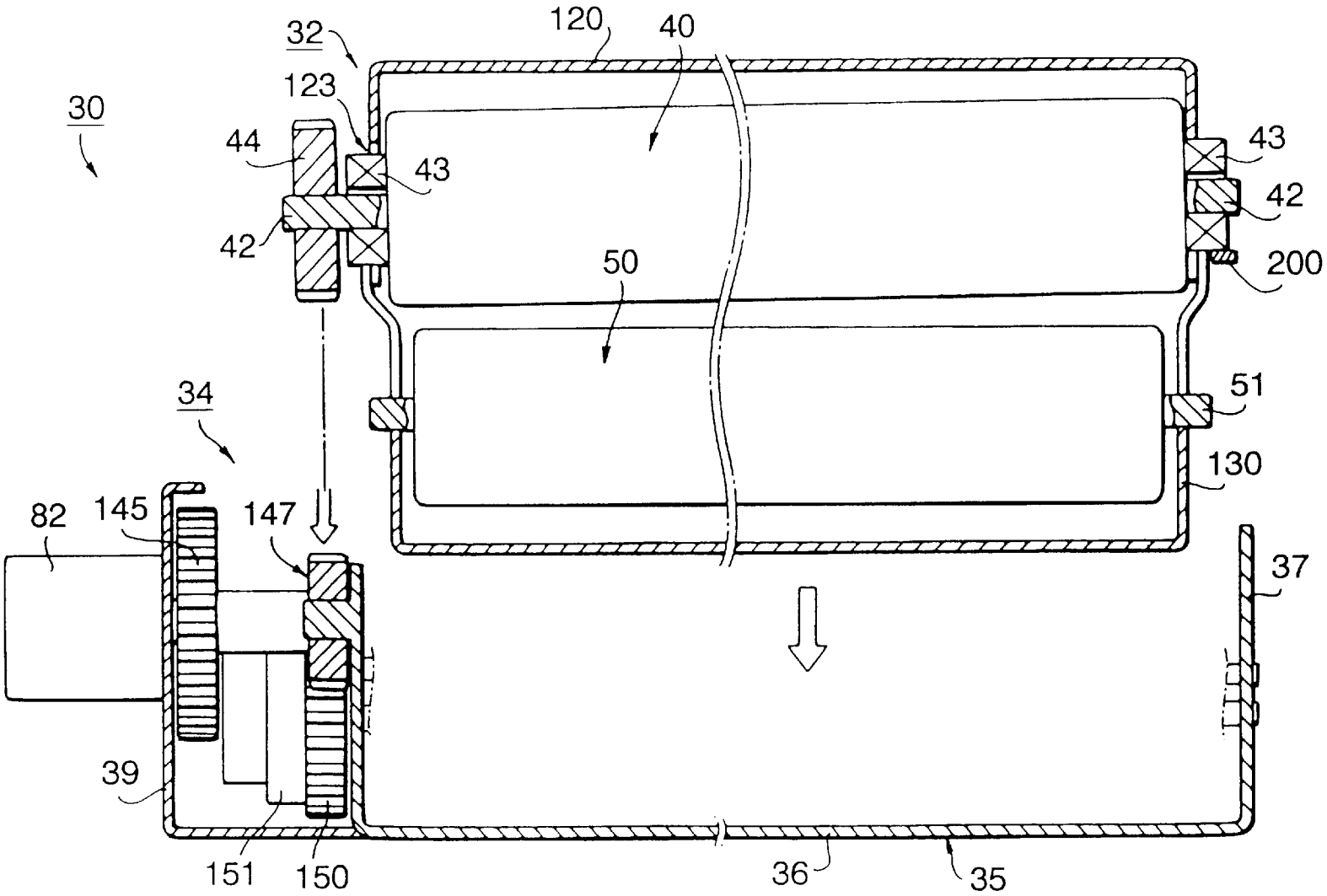
FIG. 4 is a sectional front view showing a fixing unit of FIG. 3.

FIG. 4 is a sectional view showing the fixing unit 30 seen from the downstream side (left in FIG. 1). The fixing unit 30 includes the above-described detachable unit 32, the opening/closing mechanism 33, and the rotating mechanism 34 for rotating the heat roller 40, all of which are mounted on a base frame 35. The base frame 35 has a rectangular bottom plate 36 and opposed side plates 37 vertically extending from longitudinal ends of the bottom plate 36. Since the heat roller 40 and the press roller 50 are expendable parts, the detachable unit 32 is detachable from the base frame 35. When the detachable unit 32 is mounted to the base frame 35, the roller gear 44 of the heat roller 40 meshed with a drive gear 147.

Figure 5:
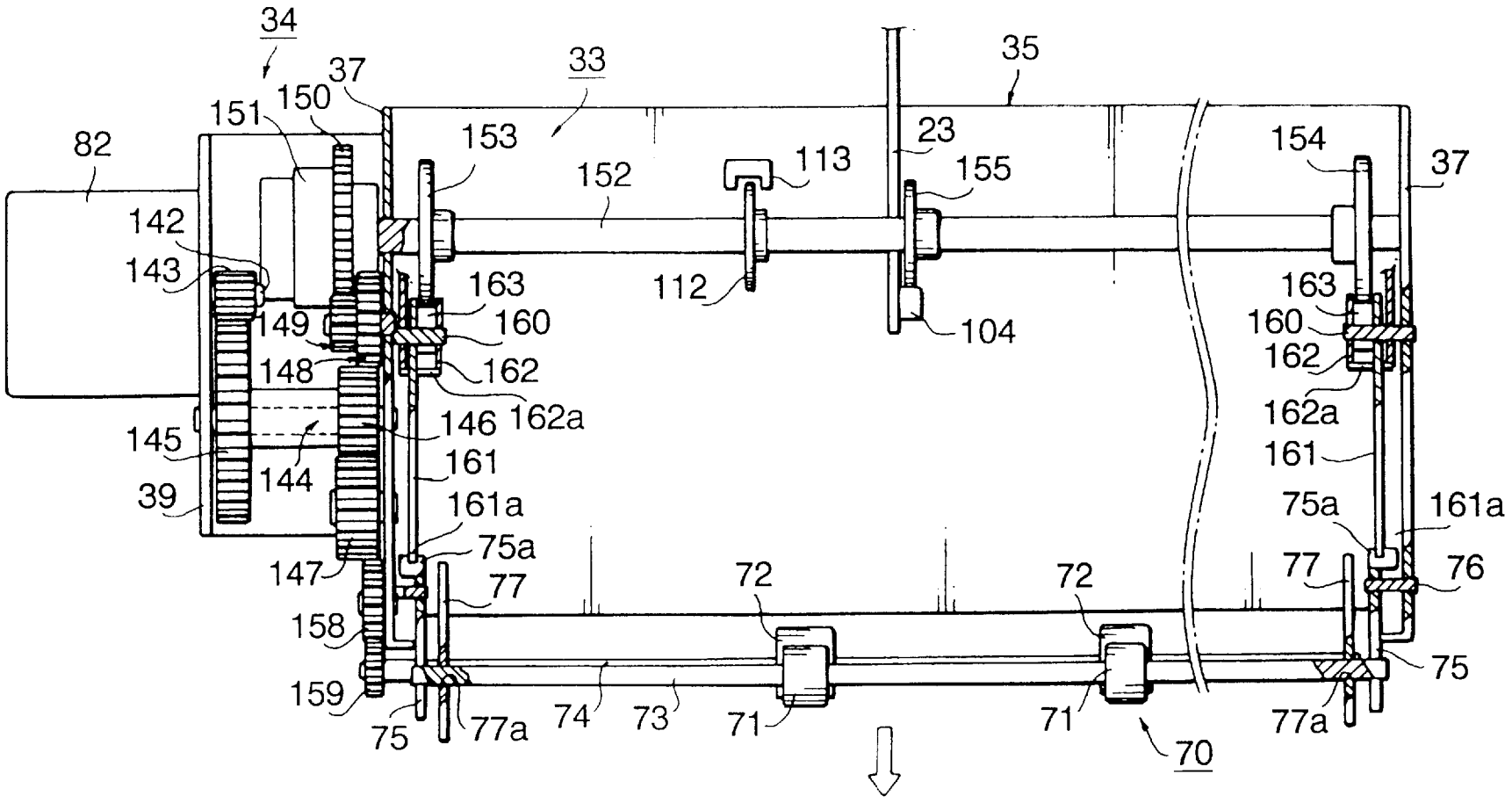
FIG. 5 is a sectional plan view showing the fixing unit of FIG. 3.

FIG. 5 is a plan view of the fixing unit 30 with the detachable unit 32 omitted. In FIG. 5, an arrow denotes a feeding direction of the recording sheet. The motor mounting plate 39 is vertically oriented, and provided parallel with the associated side plate 37. The fixing motor 82 is fixed on the mounting plate 39, so that an output shaft 142 of the fixing motor 82 protrudes toward this side plate 37. A motor gear 143 is fixed to the output shaft 142 of the fixing motor 82. The motor gear 143 meshes with a first gear 145 rotatably provided to a support shaft 144 bridging the side plate 37 and the motor mounting plate 39. A second gear 146 is provided to the support shaft 144 so that the second gear 146 is integrally rotatable with the first gear 145. The second gear 146 meshes with a third gear 147 rotatably supported on the side plate 37. The third gear 147 meshes with the roller gear 44 (FIG. 3) of the heat roller 40.

As shown in FIG. 5, the second gear 146 meshes with a fourth gear 148 rotatably supported on the side plate 37. A fifth gear 149 is fixed coaxially with the fourth gear 148. A sixth gear 150 meshes with the fifth gear 149, which is connected via a electromagnetic clutch 151 to a cam shaft 152. Thus, a driving force of fixing motor 82 is transmitted to the cam shaft 152 according to an on-off condition of the electromagnetic clutch 151.

The cam shaft 152 extends in the longitudinal direction of the base frame 35 (i.e., parallel with the press roller 50). Both axial ends of this cam shaft 152 are supported by the opposed side plates 37 and 37 of the base frame 35. First and second disk cams 153 and 154 are fixed on the cam shaft 152 at predetermined inward portions adjacent to the side plates 37 and 37, respectively. The first and second disk cams 153 and 154 are used for moving the press roller 50 thereby to open and close the gap between the heat roller 40 and the press roller 50. An encoder wheel 112 is fixed at a longitudinal central portion of the cam shaft 152. A photo-interrupter 113 is provided on the bottom plate 36 of the base frame 35 at a position adjacent to the encoder wheel 112. The encoder wheel 112 and the photo-interrupter 113 cooperatively detect a rotational angle of the cam shaft 152. A third disk cam 155 is fixed on the cam shaft 152 at the longitudinal central portion. The third disk cam 155 is used for swinging the swing holder 22 holding the corona charger 19 of the transfer unit 20 (FIG. 1). Specifically, the third disk cam 155 contacts a cam follower 104 fixed on the end of slide arm 23 (FIG. 5). The rotation of the cam shaft 152 is converted into reciprocal motion of the slide arm 23, causing the swinging of the swingable holder 22.

The discharge roller unit 70 is provided on the base frame 35 at the downstream end (i.e., down side in FIG. 5). The discharge roller unit 70 includes upper and lower support shafts 73 and 74 extending in the longitudinal direction of the base frame 35. Two upper rollers 71, 71 are fixed to the upper support shaft 73, and two lower rollers 72, 72 are fixed to the lower support shaft 74, for holding the recording sheet P (FIG. 1) therebetween. At longitudinal ends of the base frame 35, a pair of plate members 77, 77 are provided to support the support shafts 73, 74. Both ends of each of the support shafts 73, 74 are inserted into holes formed in the plate members 77, 77. The holes 77*a*, 77*a* are elongated holes, extending vertically and allowing a vertical movement of the support shaft 73. The discharge gear 159 is fixed to one end of the support shaft 74 and is connected to the drive gear 147 via an intermediate gear 158. When the fixing motor 82 is driven, the lower roller 72 (of the discharge roller unit 70) and the heat roller 40 is driven.

Figure 6A:
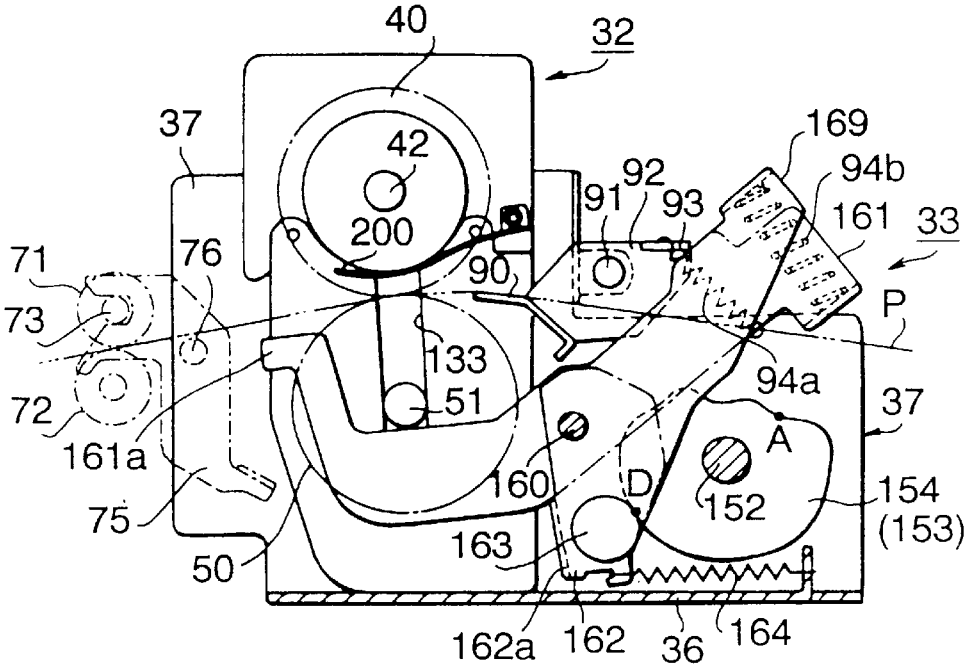
FIGS. 6A and 6B are sectional side views showing the operation of fixing unit of FIG. 3.
Figure 6B:
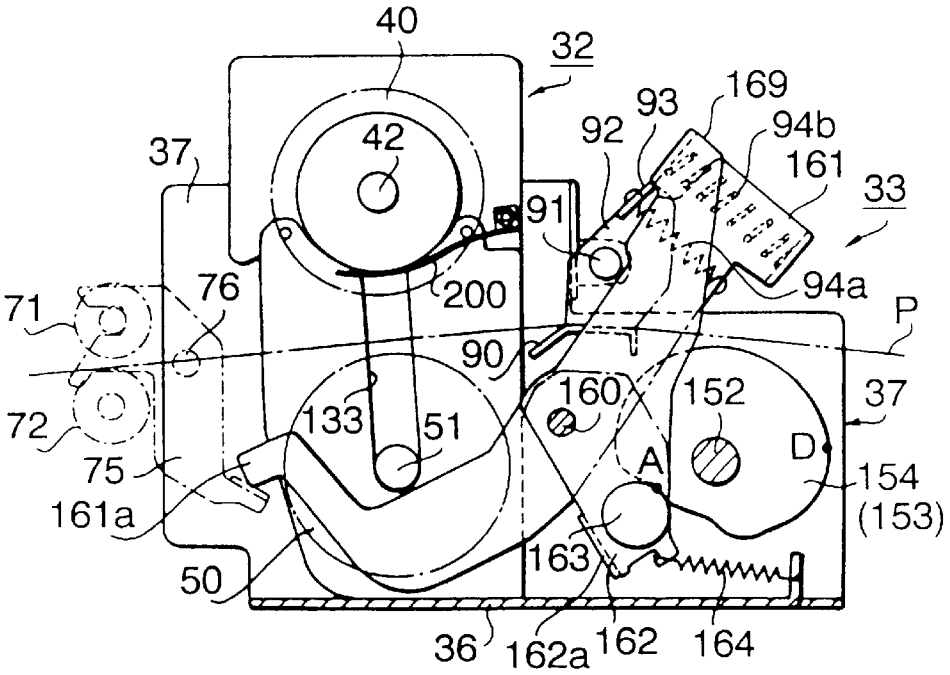

FIGS. 6A and 6B are sectional side views showing the fixing unit 30. The center shaft 51 of the press roller 50 is held by a pair of swing arms 161 (one of which is not shown in FIGS. 6A and 6*b*). Each swing arm 161 is swingable about a swinging shaft 160 provided on each side plate 37, so that the press roller 50 is moved in the substantially vertical direction along the grooves 133.

A cam follower 163 (engaging the disk cam 153) is provided to a first plate 162 rotatably provided around the shaft 160. The first plate 162 is integrally formed (movable together) with a second plate 169 parallel to the first plate 162, with a bridge plate 162*a* bridging both plates 162 and 169. The second plate 169 and the first plate 162 are integrally swingable with the swing arm 161 via a compression spring 94*b* provided between the second plate 169 and the swing arm 161. The first plate 162 is biased by a tension spring 164 having one end fixed to the bottom plate 36, so that the cam follower 163 always engages the disk cam 153. Thus, a rotation of the disk cam 153 is transmitted to the cam follower 163 and is converted into swinging motion of the plates 169 and 162, which is further transmitted to the swing arm 161. The fixing unit 30 is provided with two sets of the disk cam 153, the cam follower 163, the first plate 162 and the second plate 169 (as shown in FIG. 5), for swinging the two swinging arms 161 supporting both ends of the press roller 50.

With such an arrangement, the press roller 50 is vertically moved by the swinging of the swing arm 161. The disk cam 153 has a maximum radius at a point "D" and a minimum radius at a point "A". When the maximum radius point "D" of disk cam 153 contacts with the cam follower 163, the press roller 50 is pressed against the heat roller 40 as shown in FIG. 6A. When the minimum radius point "A" of disk cam 153 contacts with the cam follower 163, the press roller 50 is separated from the heat roller 40 as shown in FIG. 6B. In this manner, the press roller 50 is moved between the operating position and the retracted position.

In order to guide the recording sheet P through the gap between the heat roller 40 and the press roller 50, a swingable guide plate 90 is provided. The guide plate 90 is fixed to two side plates 92 and 92 (only one of which is shown in FIGS. 6A and 6B). Each side plate 92 is rotatably supported around a shaft 91 provided on respective side plate 37. The guide plate 90 is provided with a flange 93 abutting the upper end of the swing arm 161. A tension spring 94*a* is provided between the flange 93 and the swing arm 161. When the swing arm 161 is positioned at the retracted position (FIG. 6B), the recording sheet P is separated from both of the heat roller 40 and the press roller 50 by the guide plate 90.

In order to open and close the gap between the upper and lower rollers 71, 72 of the discharge roller unit 70, a swing lever 75 is provided. The swing lever 75 is swingably supported by pins 76 (FIG. 5) provided to the side plate 37. The upper end of the swing lever 75 is bifurcated to hold the support shaft 73 of the upper roller 71.

Figure 7A:
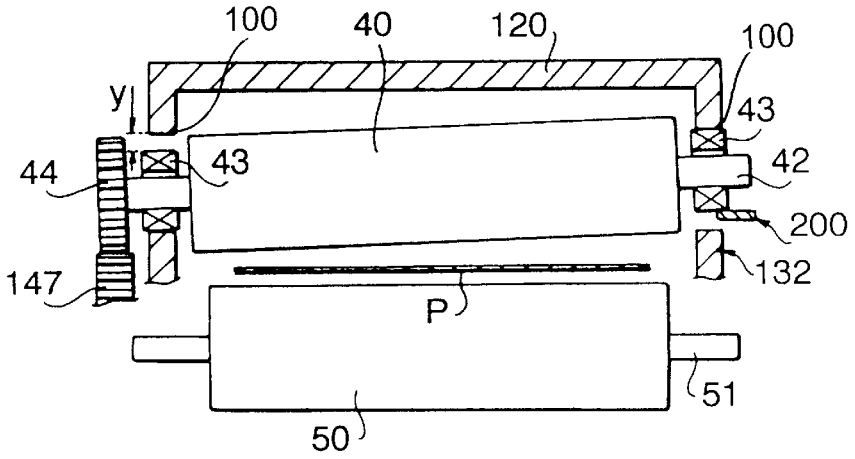
FIGS. 7A, 7B and 7C are schematic views showing the operation of the fixing unit of FIG. 3.
Figure 7B:
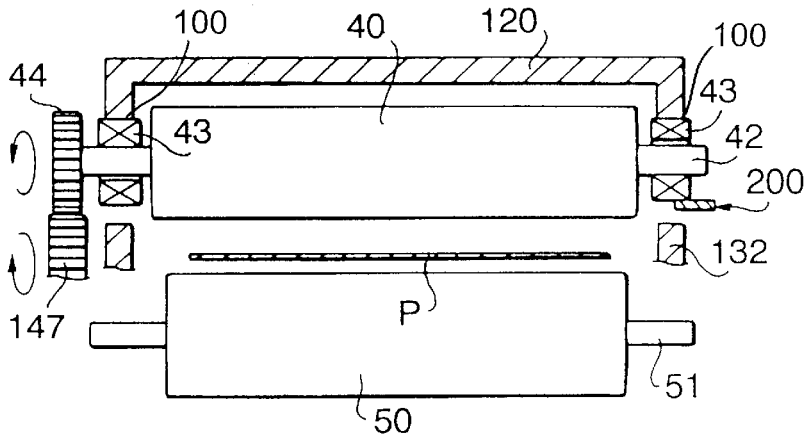
Figure 7C:
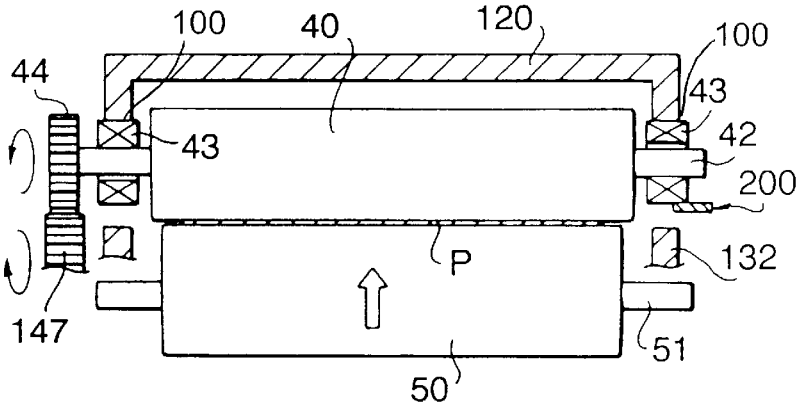

The arrangement for preventing skew of the recording sheet is described with reference to FIGS. 7A, 7B and 7C. As shown in FIG. 2, a receiving member 100 for supporting the bearings 43 of the heat roller 40 is defined by the cylindrical surface of the groove 123 and the upper end 132*a* of the side plate 132. As shown in FIG. 7A through 7C, a clearance is provided to each bearing 43 and respective receiving member 100.

In FIG. 7A, the heat roller 40 is not rotated and therefore no power is transmitted to the roller gear 44 from the gear 147. Further, one of the bearings 43 provided to an end opposite to the roller gear 44 is urged upward to the upper end of the receiving member 100. On the other hand, the other bearing 43 provided to an end of the roller gear 44 is not urged, and stays at the lower end of the receiving member 100. Thus, the heat roller 40 is inclined with respect to the press roller 50. When the heat roller 40 starts rotating as shown in FIG. 7B, the roller gear 44 is biased upward due to the force of the meshing engagement of the roller gear 44 and the drive gear 147 pushing the roller gear 44 up by the amount of clearance y. Accordingly, the heat roller 40 becomes parallel to the press roller 50.

Thus, when the press roller 50 is moved toward the press roller 50 to nip the recording sheet P therebetween as shown in FIG. 7C, the recording sheet P is nipped between the press roller 50 and the heat roller 40 in such a manner that the heat roller 40 and the press roller 50 are parallel to each other. Therefore, both lateral ends of the recording sheet are brought into contact with the press roller at the same time. Thus, this arrangement prevents the so-called skew caused when one lateral end of the recording sheet is brought into contact with the press roller earlier than the other lateral end thereof.

The plate spring 200 can be used as a ground plate for removing the undesirable static electricity of the heat roller 40. The surface of the heat roller 40 and the bearing 43 are made of electrically conductive materials. Thus, by connecting the plate spring 200 to a ground terminal (not shown) of the printer, static electricity, which may easily occur at the surface of the heat roller 40, can be reduced.

Figure 8:
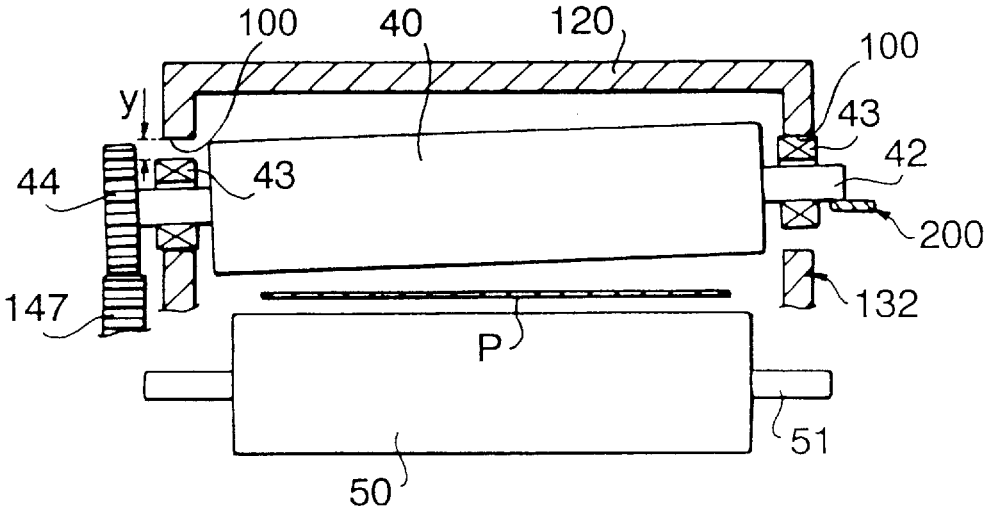
FIG. 8 is a schematic view showing the variation of the first embodiment.

FIG. 8 shows a variation of the first embodiment. In this variation, a plate spring 210 is arranged to directly press the shaft 42 of the heat roller 40. With such an arrangement, since the shaft 42 contacts the plate spring 210, the bearing 43 needs not to be made of electrically conductive materials for removing static electricity of the heat roller 40.

Figure 9A:
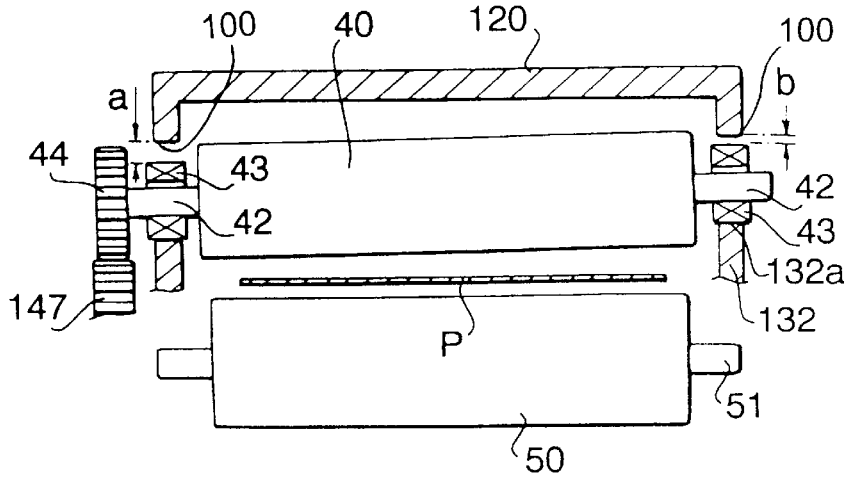
FIGS. 9A, 9B and 9C are schematic views showing the operation of the fixing unit of a second embodiment.
Figure 9B:
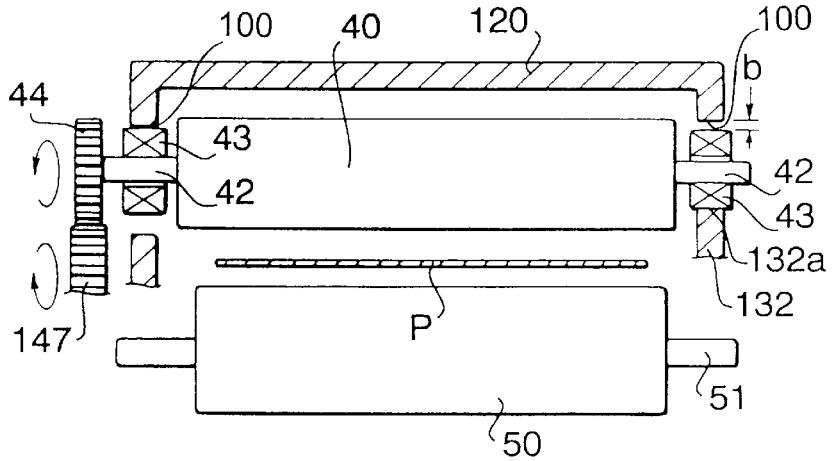
Figure 9C:
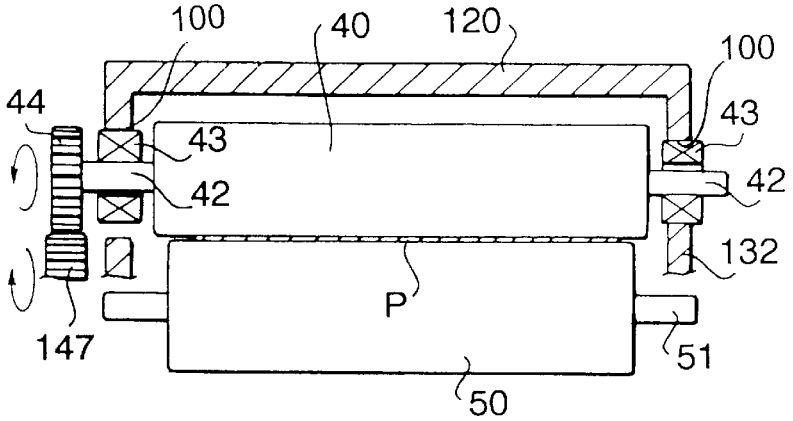

The second embodiment of the present invention is descried with reference to FIGS. 9A through 9C.

In the second embodiment, a clearance "a" between the receiving member 100 and the bearing 43 at the roller gear 44 side is set larger than a clearance "b" at the opposite side. Further, the upper end of the receiving members 100 at both sides have the same height. That is, when the heat roller 40 is not rotated as shown in FIG. 9A, the heat roller 40 is inclined with respect to the press roller 50. The difference between the clearance "a" and "b" is set to be same as the estimated raising amount of the bearing 43 at the roller gear 44 side (due to the meshing engagement of the roller gear 44 and drive gear 147). For example, if the raising amount of the bearing 43 at the roller gear 44 side is 0.5 mm, the clearance "a" may be sent to, e.g., 0.7 mm and the clearance "b" may be set to, e.g., 0.2 mm.

As constructed above, when the heat roller 40 starts rotating and the roller gear 44 is raised upward by the meshing engagement of the roller gear 44 and the drive gear 147, the heat roller 40 and the press roller 50 become substantially parallel as shown in FIG. 9B. Accordingly, when the press roller 50 moves toward the heat roller 40 to nip the recording sheet P therebetween as shown in FIG. 9C, the heat roller 40 and the press roller 50 are parallel. Therefore, both lateral ends of the recording sheet are brought into contact with the press roller at the same time. Thus, this arrangement prevents the skew caused when one lateral end of the recording sheet is brought into contact with the press roller earlier than the other lateral end thereof.

In the second embodiment, even if the raising amount of the bearing 43 at the roller gear 44 side is not completely accurately the same as the difference between clearances "a" and "b", the time difference after one lateral end of the recording sheet contacts the press roller until the other end contacts the press roller can be reduced. Accordingly, the possibility of skew is reduced.

Although the structure and operation of a fixing unit is described herein with respect to the preferred embodiments, many modifications and changes can be made without departing from the spirit and scope of the invention.

The present disclosure relates to subject matter contained in Japanese Patent Application No. HEI 08-224395 filed on Aug. 7, 1996, which is expressly incorporated herein by reference in its entirety.

What is claimed is:

1. A fixing unit for fixing images on a recording sheet, comprising:

a heat roller accommodating a heater and having a shaft member at both axial ends thereof;

two receiving members which receive both shafts of said heat roller, a clearance being provided between each shaft and respective receiving member;

a press roller movable toward and away from said heat roller;

an opening/closing mechanism which moves said press roller to open and close a gap between said press roller and said heat roller;

a rotating mechanism which rotates said heat roller, said rotating mechanism provided to the same side as said press roller with respect to said heat roller;

a driven gear provided to one shaft member of said heat roller, said driven gear being driven by said rotating mechanism; and a biasing member which biases the other shaft of said heat roller away from said press roller within said clearance, so that said heat roller and said press roller become parallel when said one shaft member is urged away from said press roller due to the meshing engagement of said driven gear and said rotating mechanism.

2. The fixing unit according to claim 1, further comprising bearings provided between said shaft members and said receiving members.

3. The fixing unit according to claim 2, wherein said biasing member presses one of said bearings.

4. The fixing unit according to claim 3, wherein a surface of said heat roller, said biasing member and said bearings are made of electrically conductive materials; and wherein said surface of said heat roller can be electrically grounded by connecting said biasing member to a predetermined ground terminal.

5. The fixing unit according to claim 1, wherein said biasing member directly presses one of said shaft members.

6. The fixing unit according to claim 5, wherein a surface of said heat roller and said biasing member are made of electrically conductive materials; and wherein said surface of said heat roller being electrically grounded by connecting said biasing member to a predetermined ground terminal.

7. The fixing unit according to claim 1, wherein said biasing member includes a spring member.

8. The fixing unit according to claim 1, further comprising a housing accommodating said heat roller and said press roller, wherein said receiving members are formed on said housing.

9. The fixing unit according to claim 1, wherein said heat roller is located above said press roller.

10. A fixing unit for fixing images on a recording sheet, comprising:

a heat roller accommodating a heater and having a shaft member at both axial ends thereof;

two receiving members which receive both shafts of said heat roller, a clearance being provided between each shaft and respective receiving member;

a press roller movable toward and away from said heat roller;

an opening/closing mechanism which moves said press roller to open and close a gap between said press roller and said heat roller;

a rotating mechanism which rotates said heat roller, said rotating mechanism provided to the same side as said press roller with respect to said heat roller; and a driven gear provided to one shaft member of said heat roller, said driven gear being driven by said rotating mechanism, said receiving members supporting said shaft members so that said one shaft member of said heat roller is closer to said press roller than the other shaft member, so that said heat roller and said press roller become parallel when said one shaft member is urged away from said press roller due to the meshing engagement of said driven gear and said rotating mechanism.

11. The fixing unit according to claim 10, wherein a clearance between said one shaft and said receiving member is set larger than a clearance between said the other shaft and said receiving member.

12. The fixing unit according to claim 11, further comprising bearings provided between said shaft members and said receiving members.

13. The fixing unit according to claim 10, further comprising a housing accommodating said heat roller and said press roller, wherein said receiving members are formed on said housing.

14. The fixing unit according to claim 10, wherein said heat roller is located above said press roller.

* * * * *